US007232967B2

(12) United States Patent
Rupp

(10) Patent No.: US 7,232,967 B2
(45) Date of Patent: Jun. 19, 2007

(54) DOOR-OPENING SENSOR AND REFRIGERATOR EQUIPPED THEREWITH

(75) Inventor: Claudia Rupp, Neresheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/926,419

(22) Filed: Aug. 25, 2004

(65) Prior Publication Data

US 2005/0029080 A1 Feb. 10, 2005

Related U.S. Application Data

(63) Continuation of application No. PCT/EP03/01087, filed on Feb. 4, 2003.

(30) Foreign Application Priority Data

Feb. 25, 2002 (DE) ..... 102 08 057

(51) Int. Cl.
*H01H 36/00* (2006.01)

(52) U.S. Cl. ..... 200/61.62; 340/547; 439/248

(58) Field of Classification Search ..... 200/61.58 R, 200/61.19, 61.62–61.68; 335/205–207; 439/246–248; 340/545, 545.6, 547
See application file for complete search history.

(56) References Cited

U.S. PATENT DOCUMENTS 4,241,337 A * 12/1980 Prada ..... 200/61.69
4,707,684 A * 11/1987 Janke et al. ..... 200/61.62
5,002,497 A * 3/1991 Plocek et al. ..... 439/248
5,070,319 A 12/1991 Scuka

FOREIGN PATENT DOCUMENTS

| | | | |
|---|---|---|---|
| DE | 29 05 698 | A1 | 8/1980 |
| DE | 36 05 067 | C1 | 7/1987 |
| DE | 89 09 115.9 | U1 | 11/1989 |
| DE | 197 20 601 | C1 | 10/1998 |
| JP | 07318234 | A | 12/1995 |
| JP | 08303945 | A | 11/1996 |
| JP | 2000161846 | A | 6/2000 |

* cited by examiner

*Primary Examiner*—K. Lee
*Assistant Examiner*—M. Fishman
(74) *Attorney, Agent, or Firm*—Russell W. Warnock; Craig J. Loest

(57) ABSTRACT

An open-door sensor for a refrigeration device contains a magnetically operated switch and a housing that surrounds the switch. Plug-in contacts for the switch are accessible from one side of the housing. The housing is equipped with detachable fixing elements for fixing the housing in a cavity. This results in a compact and inexpensive sensor for the refrigeration device.

18 Claims, 5 Drawing Sheets

DOOR-OPENING SENSOR AND REFRIGERATOR EQUIPPED THEREWITH

CROSS-REFERENCE TO RELATED APPLICATION

This application is a continuation, under 35 U.S.C. § 120, of copending international application No. PCT/EP03/01087, filed Feb. 4, 2003, which designated the United States; this application also claims the priority, under 35 U.S.C. § 119, of German patent application No. 102 08 057.7, filed Feb. 25, 2002; the prior applications are herewith incorporated by reference in their entirety.

BACKGROUND OF THE INVENTION

Field of the Invention

Refrigerators are usually equipped with a switch for sensing an opening or closing of their door or doors.

A known type of switch used here is constituted by mechanically actuated electric switches that are installed on the housing of the refrigerator, in the vicinity of the door, and interact with an operating cam on the door. Such a switch may be fixed, for example, in a front metal or plastic strip on the front side of the refrigerator, just above or beneath a door, and can be actuated via a through-passage in the front strip. The switch is actuated via a body that is fixed to the door. In this system, the switch, in the case of repair, can usually be removed without any destructive effect, and a new switch can be installed at the same location.

One disadvantage of this solution is the mechanical sensitivity of the switch, in particular of its moveable push rod that is to be actuated by the door. The push rod may be damaged, in particular, during transportation of such a refrigerator. If the door is not positioned precisely, e.g. because the hinge-mounting of the door has been changed during set-up of the refrigerator or because the door has been subjected to heavy loading, it may be the case that the push rod and the switching body of the door do not overlap to a sufficient extent and the switch thus does not perform a switching function.

A further disadvantage may arise if the switch is installed beneath a refrigerating/freezer compartment from which water can escape, for example, during the defrosting cycle. The necessity for the moveable push rod gives rise to a gap in the switch-enclosing housing, through which water can possibly penetrate into the interior of the switch and come into contact with live parts.

In order to counteract the problems associated with inaccurate positioning of the door and, in particular, the ingress of moisture, it is known to use, in a door-opening sensor, a magnetically actuated switch, in particular a reed switch, in combination with a magnet fastened on the door. Such a switch may be installed, for example, by being set in foam in the basic structure of the refrigerator, in the vicinity of the door. The disadvantage of this solution is that, in the case of malfunctioning, such a switch cannot be exchanged without any destructive effect.

In order to eliminate the disadvantage of the lack of access to the magnetically actuated switch, it has been proposed to fit the switch on a printed circuit board which bears the control electronics of the refrigerator and is accommodated in a plastic housing fastened on the front side of the refrigerator. In the case of repair, the latter can be carried out by virtue of the plastic housing being removed and then the defective magnetically controlled switch being unsoldered and a replacement switch being soldered in.

In an improved configuration, the magnetically actuated switch, rather than being soldered directly onto the printed circuit board carrying electronic components, is soldered onto an auxiliary printed circuit board that, for its part, is provided with electric lines and/or a plug in order to produce the connection to the electronics printed circuit board. This has the advantage that the magnetically actuated switch can be placed in the interior of the plastic housing at a different location from the electronics printed circuit board itself. It is still unsatisfactory, however, that, even with this configuration, the switch can only be positioned within the interior of the housing in which the electronics printed circuit board is also located. This switch can thus only be used to sense the opening and closing of the door that is disposed directly above or beneath the housing. In particular in the case of a refrigerator with a number of doors, this known solution cannot be used for a door that is not adjacent to the housing of the electronics printed circuit board.

SUMMARY OF THE INVENTION

It is accordingly an object of the invention to provide a door-opening sensor and a refrigerator equipped therewith which overcomes the above-mentioned disadvantages of the prior art devices of this general type, which is not susceptible to the influence of moisture, can be installed in a refrigerator housing in largely any desired position in the vicinity of the door and can easily be exchanged.

With the foregoing and other objects in view there is provided, in accordance with the invention, a door-opening sensor for a refrigerator. The sensor contains a contactlessly actuated switch, and a housing enclosing the switch. The housing has a releasable fastener for fastening the housing in an opening. Plug-in contacts are electrically connected to the switch and provide an electrical contact-connection to the switch being accessible on one side of the housing.

Since the switch of the sensor is configured with a dedicated housing and also with plug-in action, it can be installed at any desired location of the refrigerator housing where an opening for accommodating the switch can be produced.

The switch, preferably a reed switch, is expediently installed on a printed circuit board which is accommodated in the housing and of which a periphery bears the plug-in contacts which are required for the contact-connection of the switch. The plug-in contacts are preferably configured as conductor-track portions on the periphery of the printed circuit board.

The housing may be open on its rear side, with the result that the printed circuit board can readily be pushed into the housing via the open rear side. Penetration of moisture via the open rear side is not to be expected if suitable sealing is provided between the front region of the housing and the periphery of the opening that encloses this region. This sealing may be assisted, in particular, by a collar that runs around the housing and is provided in order, in the installed state of the door-opening sensor, to butt against the front side of the wall bearing it. A sealing element may be clamped in between the collar and the front side.

In order to make it easier for the door-opening sensor to be placed in the opening, it is provided that, on its periphery which is directed toward the front side of the housing, the printed circuit board is retained, e.g. by clamping, such that it cannot be moved in the direction perpendicular to the surface and, on its periphery which bears the plug-in contacts, it has freedom of movement in the direction perpendicular to its surface. This firm clamping, on the one hand, and the freedom of movement, on the other hand, can be achieved, in particular, with the aid of grooves, in the interior of the housing, which converge in the direction of the front side of the housing and guide the printed circuit board. This freedom of movement makes it possible to compensate for any possible positional inaccuracy between the opening and contacts that are disposed on it and are provided for connection to the plug-in contacts of the switch.

In order to make it easier for the housing to be installed on a refrigerator, it is additionally possible to provide a plug-in bushing which can be installed on the inside of the wall opening thereof, into which the housing can be pushed and which has contacts which complement the plug-in contacts of the switch.

These contacts may be accommodated, in particular, in a contact component that is retained in a sleeve of the plug-in bushing, between a shoulder and a latching hook.

The invention also relates to a refrigerator having at least one door-opening sensor of the type explained above.

Other features which are considered as characteristic for the invention are set forth in the appended claims.

Although the invention is illustrated and described herein as embodied in a door-opening sensor and a refrigerator equipped therewith, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
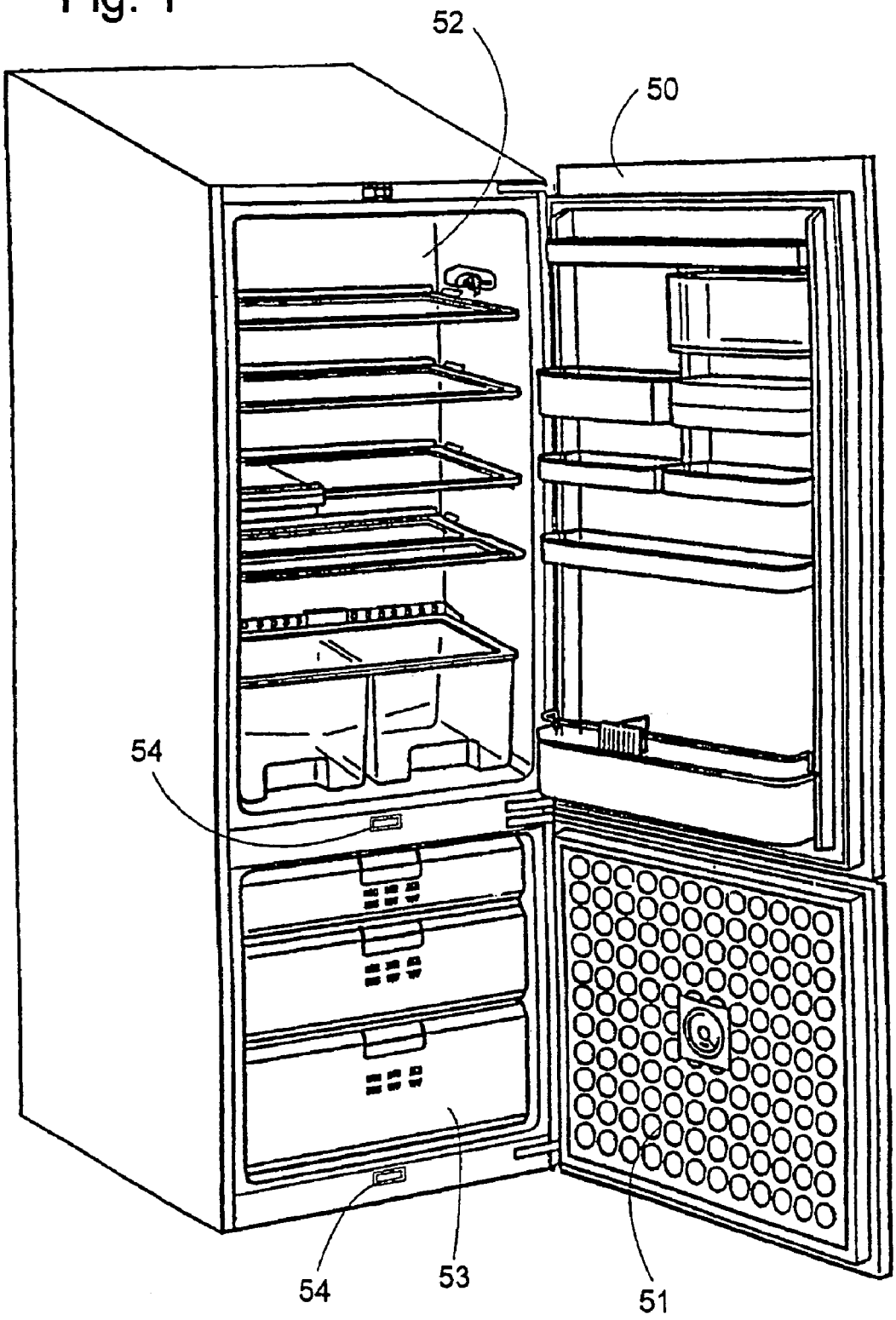
FIG. 1 is a diagrammatic, perspective view of a refrigerator according to the invention.

Referring now to the figures of the drawing in detail and first, particularly, to FIG. 1 thereof, there is shown a perspective view of a refrigerator equipped with door-opening sensors according to the present invention. The refrigerator has two doors 50, 51 each closing, for example, a normal refrigerating compartment and a chiller compartment or a normal refrigerating compartment and a freezer compartment 52, 53. A door-opening sensor 54 is disposed on the front side of the housing of the refrigerator, beneath each of the compartments 52, 53, such that it is directed toward a bottom periphery of the respective door 50, 51. The door-opening sensors 54 are disposed approximately centrally on the front side of the housing of the refrigerator, with the result that they have the same level of sensitivity irrespective of the side of the housing on which the doors 50, 51 are hinge-mounted.

A magnet which is to be sensed in each case by the door-opening sensor 54 is incorporated in the door 50, 51 in a position which is located opposite the door-opening sensor 54. It would, of course, also be possible for the door-opening sensors 54 to be disposed at other locations on the front side of the housing of the refrigerator, in particular also in openings made in the inner container of the refrigerator.

Figure 2:
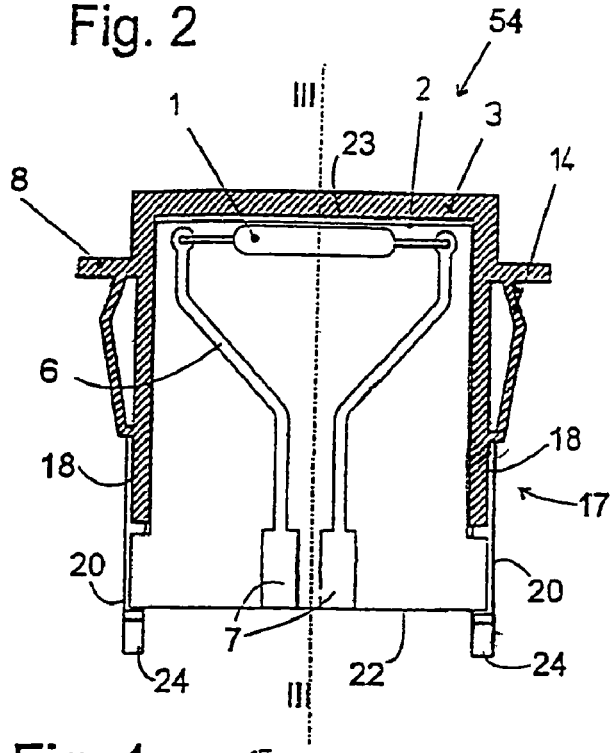
FIGS. 2 and 3 are diagrammatic, sectional views showing a section through a door-opening sensor according to the invention in two planes that are perpendicular to one another.

FIG. 2 shows a section through a door-opening sensor 54 in a horizontal plane in relation to the configuration of the door-opening sensors 54 which are shown in FIG. 1.

Figure 3:
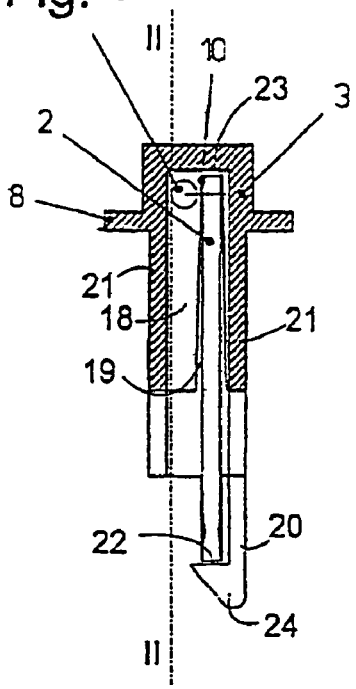

FIG. 3 shows a section through the same door-opening sensor along a vertical plane. The section plane of FIG. 3 is designated III—III in FIG. 2, and the section plane of FIG. 2 is designated II—II in FIG. 3.

The door-opening sensor 54 is essentially constructed from three parts: a reed switch 1, a printed circuit board 2, on which the reed switch 1 is soldered, and a housing 3, which accommodates the printed circuit board 2 with the reed switch 1.

The housing 3, which is produced in one piece from plastic, has a substantially cuboidal body 17, which is open on the rear side and is enclosed on four side walls by an encircling collar 8. Narrow side walls 18 of the body 17 have on their inside, as is shown in FIG. 3, a groove 19 which tapers from the open rear side to the closed front side of the body 17 and serves for guiding and securing of the printed circuit board 2. The printed circuit board 2 is retained by these grooves 19 in an essentially play-free manner in the region of the front side and with freedom of movement in the region of the rear side.

On the open rear side, the body 17 is extended by two flexible arms 20, which extend from the edges between one of the broad side walls 21 and the narrow side walls 18 and each bear a latching hook 24 at their free ends. The arms 20 can be displaced outward when the printed circuit board 2 is pushed into the groove 19 and are adapted to the length of the printed circuit board 2 such that the latching hooks 24 engage behind the rear edge 22 of the printed circuit board 2 when the front edge 23 of the latter reaches the narrow front end of the grooves 19. It is thus possible to latch the printed circuit board 2 in the housing 3.

The shape of the latching hook 24 engaging behind the rear edge 22 of the printed circuit board 2 is selected, in adaptation to the freedom of movement of the printed circuit board in the rear region of the groove 19, such that, in any position which the printed circuit board 2 can assume, the engagement between the latching hook 24 and the rear edge 22 is not lost without the arm 20 being bent at the same time.

The printed circuit board 2 bears the reed switch 1 on a surface that is directed away from the arms 20. Conductor tracks 6 extend over the surface of the printed circuit board 2 from the connections of the reed switch 1 to conductor surfaces 7 on the rear edge 22 of the printed circuit board 2, these conductor surfaces being wider than the conductor track 6 and serving as plug-in contacts for the electrical contact with the plug-in bushing illustrated in FIGS. 3 and 4.

The narrow side walls 18 bear, on their outer sides, two clasps or clips 14 which can be pressed together in the plane of FIG. 2. As will become clear in a later stage in the text, these serve for the releasable fastening of the housing 3 by latching in an opening.

Figure 4:
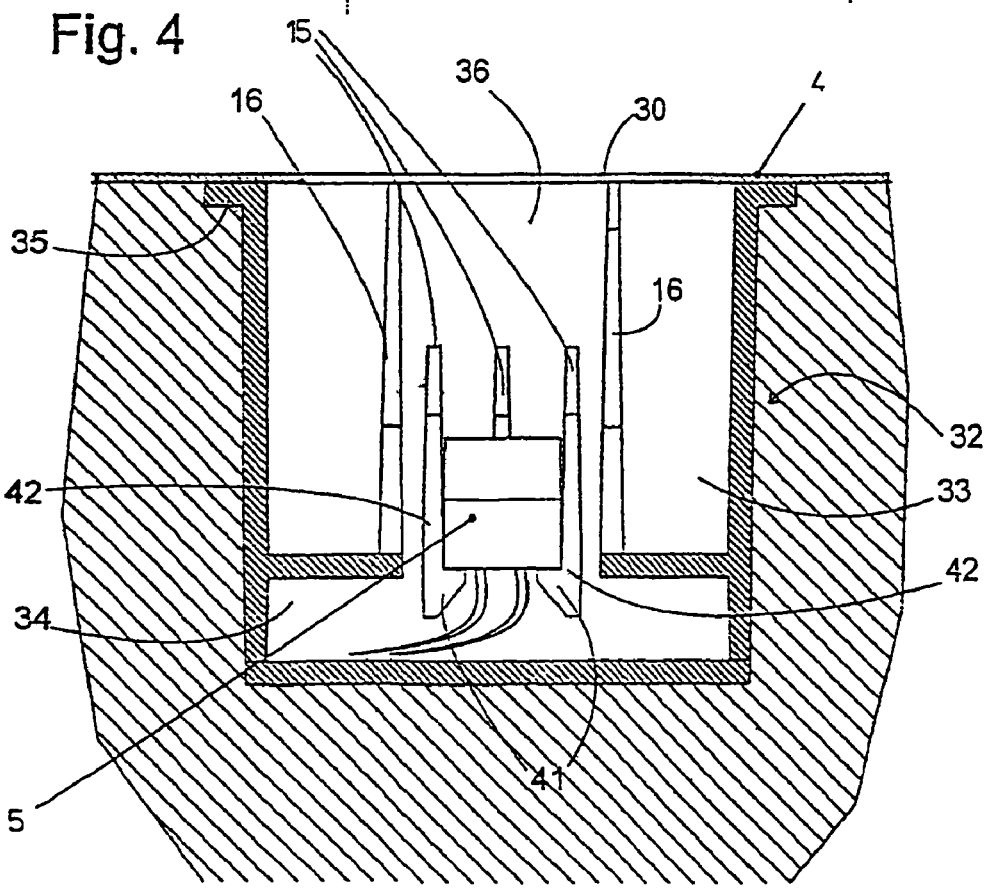
FIGS. 4 and 5 are diagrammatic, sectional views showing a section through a wall of the refrigerator with a plug-in bushing installed on the wall, each section being taken along section planes analogous to those of FIGS. 2 and 3.
Figure 5:
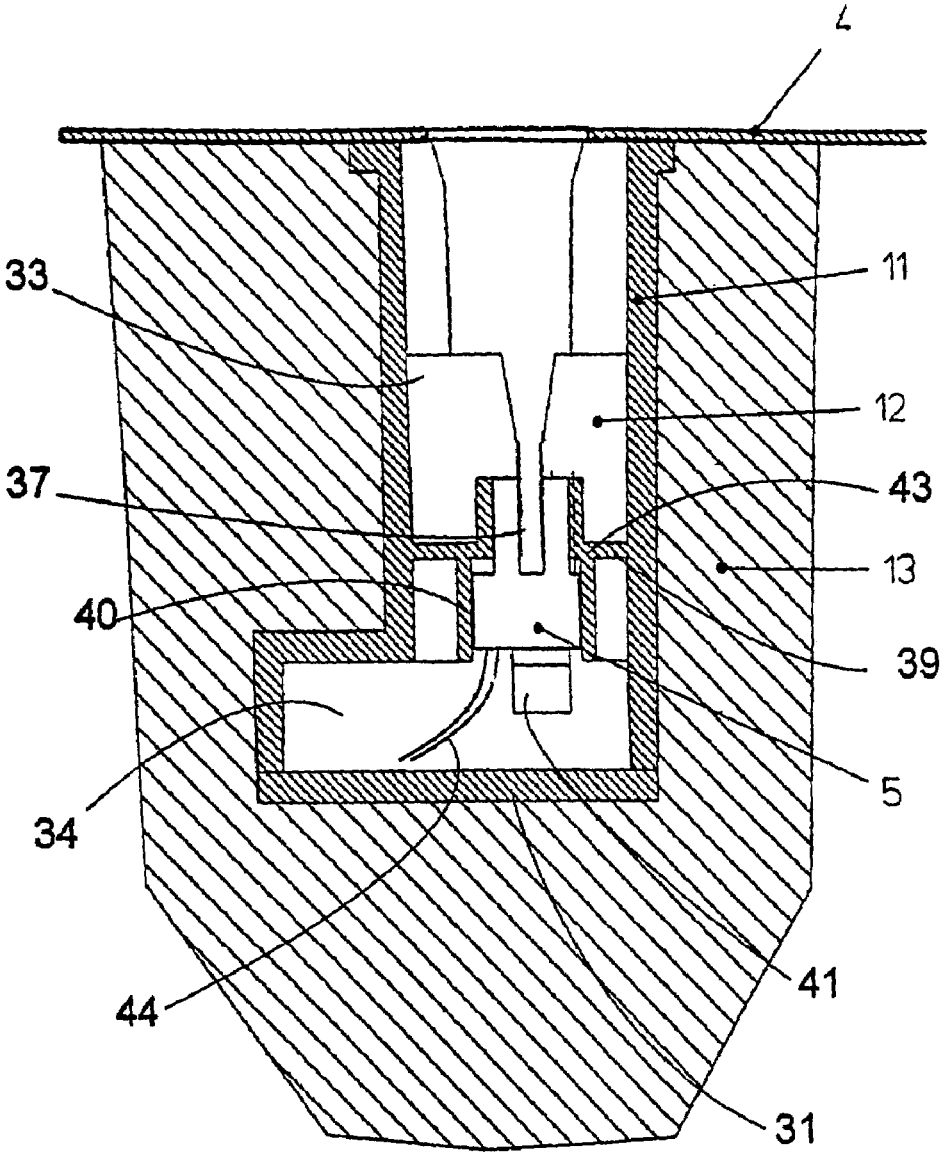

FIGS. 4 and 5 each show a section through a plug-in bushing 32 which is installed in an opening 30 of a wall 4 of the refrigerator and is provided in order to push the housing 3 into the same and to make contact with the reed switch 1.

The plug-in bushing 32, which is formed from plastic, is constructed from two approximately cuboidal, hollow portions, referred to as plug-in portion 33 and wire-feed portion 34. The plug-in portion 33 has an open front side that is directed toward the wall 4 and is enclosed by an encircling flange 35. The flange 35 is adhesively bonded firmly to the inside of wall 4. The cavity of the plug-in portion 33 is higher and wider than an opening 30 behind which it is disposed.

Broad side walls 36 of the plug-in portion 33, of which one can be seen from the view in FIG. 4, bear a plurality of ribs 15 and 16, which project into the interior of the cavity of the plug-in portion 33. Two of these ribs, the ribs 16, extend over the entire depth of the plug-in portion 33, and their height is dimensioned such that the broad side walls 21 of the housing 3 introduced into the plug-in portion 33 are retained in a play-free manner, or subjected to a slight clamping-in action, by them. The shorter ribs 15 are of such a length that they do not reach the rear side of the housing 3, once introduced, and of such a height that they guide the rear edge of the printed circuit board 2 between them, and direct it into an accommodating slot 37 of a contact component 5, when the printed circuit board is plugged in. As can be seen in FIG. 5 in particular, the contact component 5 is retained in a sleeve 40 that is formed in a wall 39 that separates the portions 33, 34 off from one another. In order to fix the contact component 5 in the plug-in direction of the housing 3, on the one hand, use is made of two latching hooks 41, which are connected to two of the short ribs 15 via flexible tongues 42 and can be displaced to the side when the contact component 5 is pushed into the sleeve 40. On the other hand, a shoulder 43 formed in the sleeve 40 limits the movement capability of the contact component 5 in the direction of the opening 30 and thus prevents the contact component from being drawn out together with the printed circuit board 2 if the door-opening sensor has to be exchanged.

Two wires 44 for the contact-connection of the reed switch 1 extend from the contact component 5, through the wire-feed portion 34, to a non-illustrated lead-through, at which they pass out of the wire-feed portion 34 into an insulating-foam layer 13, which encloses the outer sides of the plug-in bushing 32. The lead-through is formed by one or two cutouts in a side wall of the wire-feed portion 34 which are adjacent to a rear wall 31, which is separate from the rest of the wire-feed portion 34.

The door-opening sensor according to the invention is installed, in the first instance, by the flange 35 of the plug-in bushing 32 being adhesively bonded to the inside of the wall 4, enclosing the opening 30. At this point in time, it is possible for the contact component 5 already to be provided with connection wires and to be latched in the sleeve 40 and for the rear wall 31 to be fitted on the wire-feed portion 34; however, it is also possible for the contact component 5 and the rear wall 31 to be fitted only when the plug-in bushing 32 has been installed on the wall 4.

The rear wall 31 secures the wire-feed portion 34 against the penetration of the foam 13 when the door-opening sensor is encapsulated by the foam.

Once the plug-in bushing 32 has been installed on the wall 4, the housing 3 can be introduced into the plug-in portion 33 through the opening 30.

FIGS. 6 and 7 show, once again in sections taken along two planes which are perpendicular to one another, and correspond to the planes II—II and III—III, the door-opening sensor installed on the wall 4 of the refrigerator. The clips 14, which are pressed together when the housing 3 is pushed in to the opening 30, have returned to their original configuration, with the result that the housing 3 is fixed on the wall 4 by clamping between the collar 8 and the clips 14.

Figure 6:
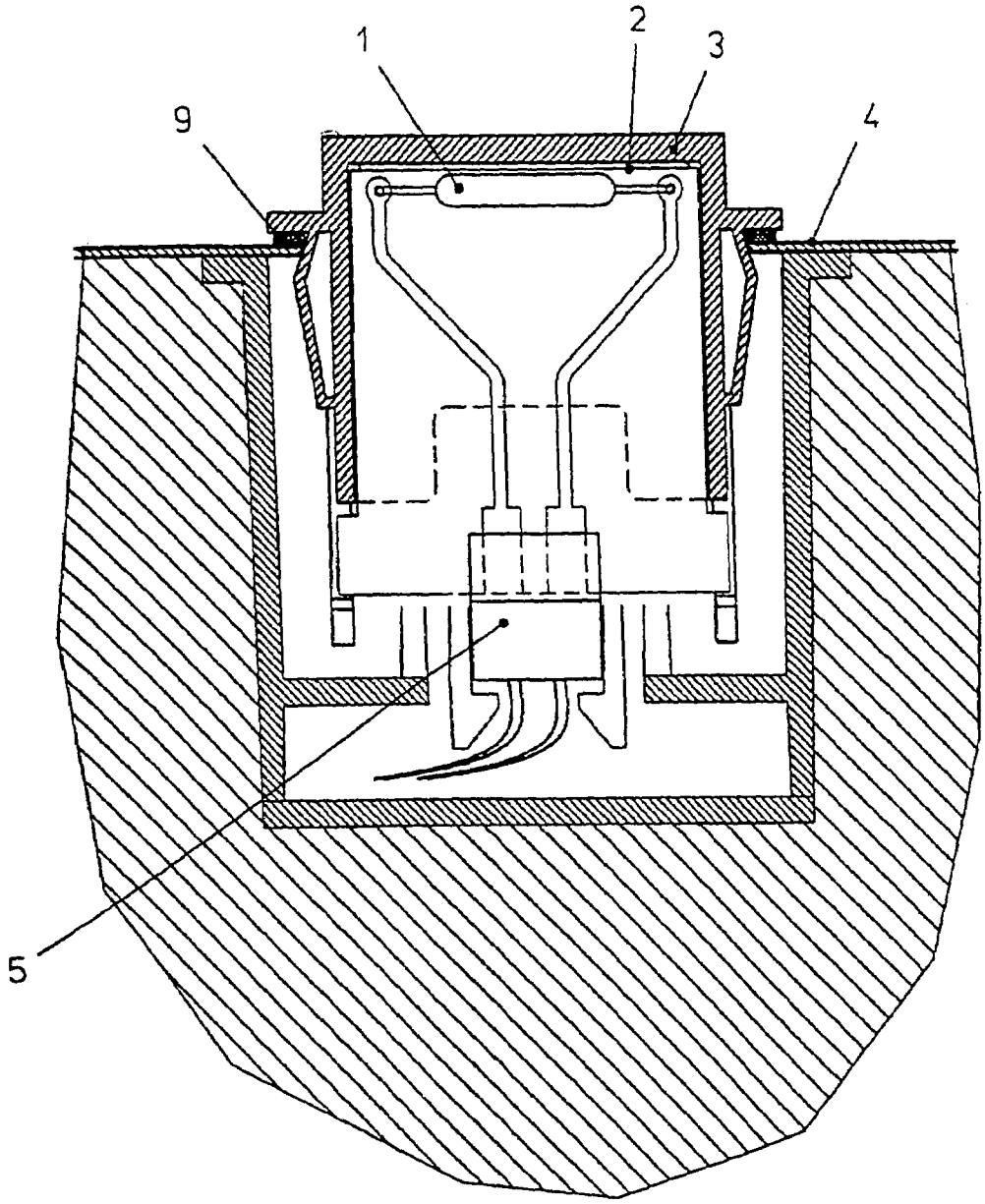
FIGS. 6 and 7 are diagrammatic, sectional views showing sections through the door-opening sensor installed in the wall, along the same section planes.
Figure 7:
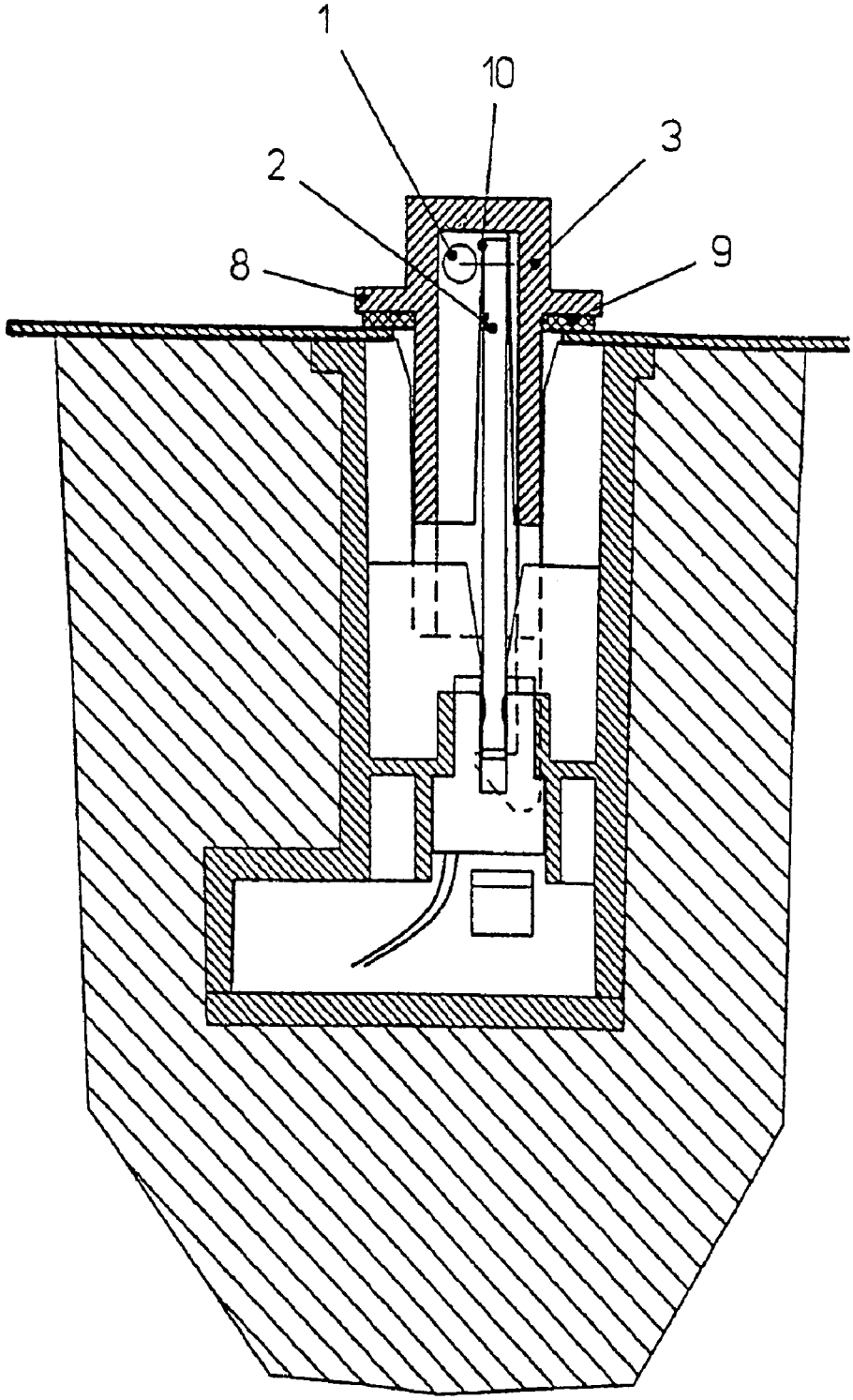

FIG. 6 shows a sealing ring 9 clamped in-between the collar 8 and the wall 4. The sealing ring may be provided as required if there is a high risk of moisture penetrating into the plug-in portion 33, e.g. because the region of the wall 4 in which the opening 30 is located may be subjected to wetting by defrosting water forming in the interior of the refrigerator.

In order to exchange the door-opening sensor in the case of malfunctioning, it is sufficient for the front region of the housing 3, this region projecting beyond the outer surface of the wall 4, to be gripped, e.g. using pliers, and drawn out of the opening 30. It is then possible, by virtue of the arms 20 being bent, for the printed circuit board 2 to be removed from the housing 3 and exchanged. All that is then required is for the housing 3 to be pushed into the opening 30 again.

I claim:

1. A door-opening sensor for a refrigerator, comprising:

the refrigerator including a wall with an opening formed therein;

a contactlessly actuated switch;

a housing enclosing said switch, said housing having a releasable fastener for fastening said housing in said wall opening;

plug-in contacts electrically connected to said switch and providing an electrical contact-connection to said switch being accessible on one side of said housing; and a printed circuit board upon which said switch is disposed, said printed circuit board having a surface bearing said plug-in contacts, wherein said plug-in contacts are conductor surfaces on said surface of said printed circuit board, said conductor surfaces being substantially coplanar with said surface of said printed circuit board.

2. The door-opening sensor according to claim 1, wherein said switch is a magnetically responsive switch.

3. The door-opening sensor according to claim 1, wherein said housing has a rear side with an opening formed therein, and said printed circuit board can be pushed into said housing through said opening.

4. The door-opening sensor according to claim 3, wherein said printed circuit board has said surface bounded by a periphery with a first portion of said surface located proximate to a front side of said housing, said first portion of said surface of said printed circuit board being retained in said housing such that said printed circuit board cannot be moved in a direction perpendicular thereto at said first portion, and a second portion of said surface located at an end of said printed circuit board proximate a back side of said housing, said second portion of said surface bearing said plug-in contacts, and said printed circuit board disposed such that said second portion of said surface of printed circuit board has freedom of movement in a direction perpendicular to said second portion of said surface.

5. The door-opening sensor according to claim 4, wherein said housing has interior grooves formed therein which are tapered in a direction of said front side and are intended for guiding said printed circuit board.

6. The door-opening sensor according to claim 1, wherein said housing has an encircling collar.

7. The door-opening sensor according to claim 1, further comprising a plug-in bushing having complementary contacts which complement said plug-in contacts connected to said switch and into said plug-in housing said housing can be pushed.

8. The door-opening sensor according to claim 7, wherein said plug-in bushing includes:

a shoulder;

a latching hook;

a sleeve formed therein; and a contact component containing said complementary contacts retained in said sleeve between said shoulder and said latching hook.

9. The door-opening sensor according to claim 1, wherein said switch is a reed switch.

10. The door-opening sensor according to claim 1, including said releasable fastener including at least a pair of clips which are pressed together in said opening to releaseably latch said housing in said wall opening.

11. A door-opening sensor for a refrigerator including a wall with an opening formed therein, said door-opening sensor comprising;

a printed circuit board including a surface having plug-in contact conductor surfaces and a contactlessly actuated switch mounted to the circuit board, the conductor surfaces being in electrical communication with the switch;

a housing including a pair of side walls with each side wall at least partially defining a tapered groove receiving the printed circuit board; and a plug-in bushing disposed within the opening and receiving the housing, the bushing including a contact component having an accommodating slot with electrical contacts, the accommodating slot receiving at least a portion of the printed circuit board and having the electrical contacts engaging the conductor surfaces and establishing an electrical connection between the printed circuit board contact and internal refrigerator wiring.

12. The door-opening sensor according to claim 11, wherein the bushing includes a set of first ribs for frictional retentive engagement with said housing and a set of second ribs engaging the circuit board and guiding the conductor surfaces of the circuit board into a mating relationship with the electrical contacts of the contact component.

13. The door-opening sensor according to claim 11, wherein the conductor surfaces are substantially coplanar with the surface of the circuit board.

14. The door-opening sensor according to claim 11, wherein the housing includes at least a pair of clips which are pressed together to releaseably latch the housing in the wall opening.

15. The door-opening sensor according to claim 11, wherein said plug-in bushing includes a sleeve releasably retaining the contact component, the sleeve including a shoulder restricting movement of the contact component in a first direction and flexible tongues with latching hooks restricting movement of the contact component in a second direction being opposite the first direction, the flexible tongues being displacable to selectively remove the contact component from the sleeve in the second direction.

16. The door-opening sensor according to claim 11, wherein the plug-in bushing includes a flange formed about a periphery thereof for contact with the wall of the refrigerator, the flange being affixed to the wall and sealed thereagainst with an adhesive.

17. A door-opening sensor for a refrigerator including a wall with an opening formed therein, said door-opening sensor comprising;

a printed circuit board extending from a front end to a rear end and including a surface, a contactlessly actuated switch mounted to the circuit board at the front end and plug-in contact conductor surfaces being disposed on the circuit board surface at the rear, conductor tracks extending along the surface and electrically connecting the switch to the conductor surfaces; and a housing including a closed front side, and open rear side, and a pair of side walls, each side wall including a tapered groove being open near the rear side and a flexible arm extending rearwardly from the housing toward an end forming a latching hook, the housing receiving the printed circuit board within the tapered grooves with the switch adjacent the closed front side and the latching hooks releasably engaging the rear end of the circuit board.

18. The door-opening sensor according to claim 17, wherein the housing includes at least a pair of clips which are pressed together to releaseably latch the housing in the wall opening.

* * * * *